US005203813A

United States Patent [19]

Fitzsimmons et al.

[11] Patent Number: 5,203,813

[45] Date of Patent: Apr. 20, 1993

[54] LOW ENTRY FORCE CONNECTOR SOCKET METHOD OF MANUFACTURE

[75] Inventors: Peter Fitzsimmons, Allen, Tex.; Mark S. Glasmeire, Moorpack, Calif.; John L. Grant, Sherborn, Mass.; Jean L. Meek, Lindale, Tex.; William J. Merritt, Moorpack, Calif.; John B. Moetteli, Dallas, Tex.

[73] Assignee: Airborn, Inc., Addison, Tex.

[21] Appl. No.: 740,927

[22] Filed: Aug. 6, 1991

[51] Int. Cl.[5] ..... H01R 43/20

[52] U.S. Cl. ..... 29/876; 439/843; 439/847

[58] Field of Search ..... 439/840, 841, 842, 843, 439/851, 847; 29/874, 876, 877, 878, 879, DIG. 8

[56] References Cited

U.S. PATENT DOCUMENTS

| | | | |
|---|---|---|---|
| 3,023,789 | 3/1962 | Bonhomme . | |
| 3,107,966 | 10/1963 | Bonhomme . | |
| 3,381,262 | 4/1968 | Jeanrenaud . | |
| 3,470,527 | 9/1969 | Bonhomme . | |
| 3,557,428 | 1/1971 | Bonhomme . | |
| 3,858,962 | 1/1975 | Bonhomme . | |
| 4,087,152 | 5/1978 | Kolm | 439/843 |
| 4,203,647 | 5/1980 | Bonhomme . | |
| 4,572,606 | 2/1986 | Neaumann et al. . | |
| 4,614,029 | 9/1986 | Neumann et al. . | |
| 4,867,709 | 9/1989 | Molitor et al. | 439/843 |

FOREIGN PATENT DOCUMENTS

| | | | |
|---|---|---|---|
| 113023 | 8/1961 | Fed. Rep. of Germany | 439/842 |

*Primary Examiner*—David L. Pirlot
*Attorney, Agent, or Firm*—H. Dale Langley, Jr.

[57] ABSTRACT

Disclosed is a low entry force connector socket having a cage with a wire basket formed within it by contact wires which are fixed to the cage in notches on the end rims thereof, and which wires are rotationally offset within the cage to form the wire basket for engaging a connector pin. The wires are mounted in the cage by being hooked on notches provided in the end rims of the cage, and are moved to their rotationally offset orientations in a series of stages, following which they are fixed in position and the external portions of the socket are mounted to enclose the cage while a tool pin is positioned in the wire basket to establish the desired connecting force of the socket.

9 Claims, 4 Drawing Sheets

LOW ENTRY FORCE CONNECTOR SOCKET METHOD OF MANUFACTURE

BACKGROUND OF THE INVENTION

In the electrical and electronic arts, many occasions arise for making reversible connections between one part of a line and another. There are many ways of forming connectors for this purpose, each of which has its own advantages and weaknesses.

A good connector reliably establishes a sound mechanical and electrical connection between the two parts of the line while being economical to construct and having a low entry force. A low entry force is desirable because in the computer and telecommunication arts, it is common to gang together a number of connectors in a single connecting device for simultaneous connection and disconnection. Dozens, or even hundreds, of connectors may be ganged together in a single unit. While in a single connector arrangement, a high entry and disconnect force may not be objectionable, when the equipment is arranged so that dozens, or even hundreds, of connections must be made or unmade simultaneously, it is essential to have a low mechanical force involved without unduly compromising the mechanical and electrical integrity of the connection once made.

One school of low entry connector socket design takes advantage of the fact that when a cylindrical array of straight wires is rotationally offset from one end to the other, there is formed what is termed herein a "basket" which in its central region is necked down to a reduced virtual diameter. Such a wire basket will yieldingly grasp a connector pin inserted thereinto. Connectors constructed in accordance with this technique are disclosed in U.S. Pat. No. 3,023,789 to Bonhomme, Mar. 6, 1962; U.S. Pat. No. 3,107,966 to Bonhomme, Oct. 22, 1963; U.S. Pat. No. 3,470,527 to Bonhomme, Sep. 30, 1969; U.S. Pat. No.3,557,428 to Bonhomme, Jan. 26, 1971; and U.S. Pat. No. 3,858,962 to Bonhomme, Jan. 7, 1975. While connectors constructed according to this design philosophy have many advantages, they have proved difficult to build with the desired uniformity, particularly in their low entry force characteristic, and have tended to be unduly expensive.

Other design approaches have included arrangements which apply forces to bow inwardly connector wires initially arranged in a cylindrical array. One such system is shown in U.S. Pat. No. 4,572,606 to Neumann, et al., Feb. 25, 1986. In general, the technique of bowing the connector wires inwardly results in harder to control entry force characteristics than does the rotationally offset wire basket technique.

SUMMARY OF THE INVENTION

In accordance with the invention, there is provided a low entry force connector socket adapted to receive a cylindrical connector pin, and having a characteristically low entry and disconnection force which is reliably uniform from one connector to another, while at the same time providing good mechanical integrity to the connection, as well as very good electrical connectivity. In addition, the present invention provides methods and techniques of manufacture which result in the superior connector socket of the invention.

In one of its preferred forms, the connector socket of the invention includes a generally cylindrical inner cage which has a plurality of wire seating notches in the end rims thereof for engaging a plurality of wires. The notches on one end rim are rotationally offset from the notches on the other end rim and the cage is also furnished with a pair of external circumferential ribs thereon spaced from another at a mid-region of the cage.

In this connector, a plurality of contact wires are mounted in the cage and have their end portions rotationally offset from one another. The end portions are seated in the above-mentioned notches by being reverse-bent into them, which forms the plurality of wires into what is here termed a wire basket for yieldingly engaging a connector pin.

A generally cylindrical outer body having a generally cylindrical cavity in it, which is sized to accommodate the cage and the reverse-bent wires at one end of the cage, is provided. The cavity is also of a depth to receive within it one of the external ribs of the cage. The connector socket is also supplied with a cap having a cavity in it sized to accommodate to cage and reverse-bent wires associated with the cage at its other end. The cap cavity is of a depth sufficient to receive within it the other of the external ribs of the cage and the cap has an axial opening in it for admitting a connector pin into the interior of the socket. When the connector is finally assembled, the inner cage is positioned in the cavity of the outer body with the cap fitted over it and the cap and the outer body are deformed around the external ribs of the cage into the space between them to thereby unite the cage, wires, body, and cap, both structurally and electrically.

In accordance with one of the preferred method aspects of the invention, a connector socket of the kind generally described above is constructed by providing wire seating notches on the rims of each end of a cage. Each of the wires involved in the construction of the device has three seating notches which are associated with it. Thus, for each wire, a first notch is provided on a first end rim of the cage, and a second notch on a second end rim of the cage, the second notch being rotationally offset from the first notch by an angle smaller than the selected angle of offset for the wire. A third notch is provided on the second cage end rim and it is rotationally offset from the first notch by the selected angle of rotational offset of the wire from one end to the other.

The wires are installed within the cage by feeding a wire into the cage in a path of movement substantially parallel to the axis of the cage. A first (preferably leading) end of the wire is hooked on the first notch mentioned above. Next, a second end of that wire is hooked on the second notch mentioned above. The hooked second end of the wire is then moved from the second notch to the third notch, thereby completing its rotational offset to the desired extent. Following this, the cage with the wire hooked thereto is enclosed in enclosing means such as a connector outer body and a cap discussed above.

To form a wire basket comprising a plurality of rotationally offset wires assembled in the manner just discussed, a plurality of such wires is employed in the construction of the device. While as few as three wires may be employed to form a wire basket in accordance with the invention, it is preferred to use at least five wires, even in connectors designed to accommodate very small diameter pins.

In accordance with another preferred method aspect of the invention, a tool pin is inserted into the wire basket after its construction within the cage (preferably in the manner just outlined), but before application of the enclosing means, such as the outer body and cap. The tool pin has a diameter which is selected in accordance with the invention in view of the diameter of the connector pin with which the socket is to be used and the desired connecting force. While the tool pin is inserted in the wire basket, the enclosing means are applied around the cage to grippingly engage the cage and the hooked ends of the wires to thereby fix the connecting force of the socket. After this is done, the tool pin is removed from the wire basket.

In a preferred device, the enclosing means are those discussed above, namely, a generally cylindrical outer body having a generally cylindrical cavity therein, and a cap having a cavity therein also designed to accommodate the cage and reverse-bent wires. It is further preferred that the cage have external circumferential ribs thereon and that the enclosing means, that is the outer body and the cap, are conformed around the external ribs to unite the cage, wires, body, and cap structurally and electrically.

From the foregoing, it can be seen that a primary object of this invention is to provide a superior connector socket having a low and controllable entry force. Another object of the invention is to provide a method for making such a connector socket which is economical to operate and which provides a quality device in which the entry and disconnect force is controllable and quite uniform from one connector socket to another.

The manner in which the foregoing objects and purposes, together with other object and purposes, are achieved may be more readily understood by considering the detailed description which follows in connection the accompanying drawings.

DESCRIPTION OF THE PREFERRED EMBODIMENTS

Figure 1:
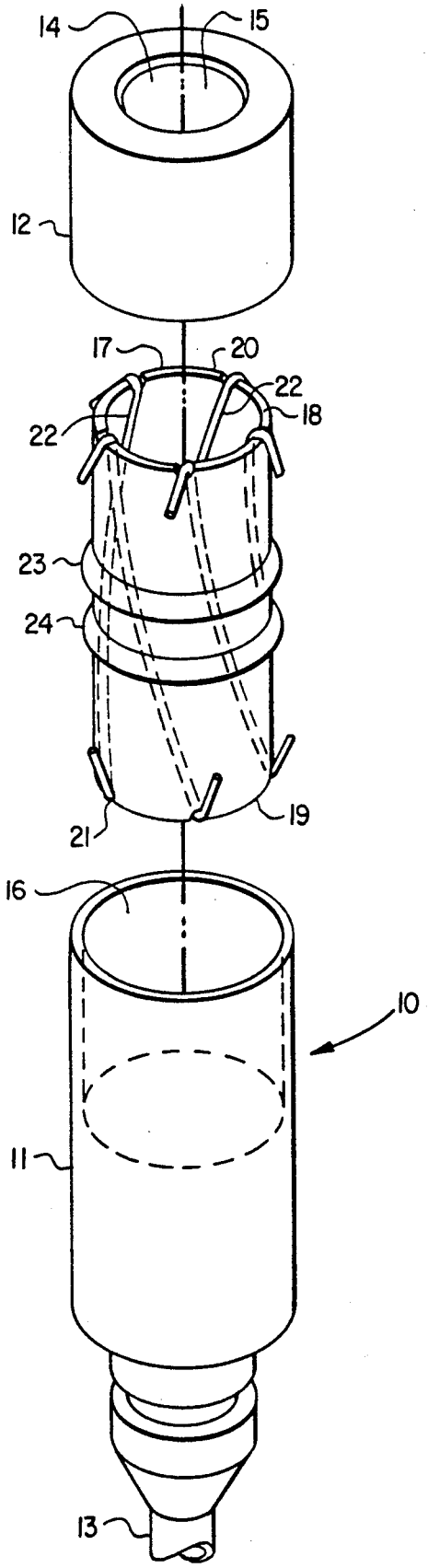
FIG. 1 is an exploded isometric view of a connector socket constructed in accordance with the invention.
Figure 2:
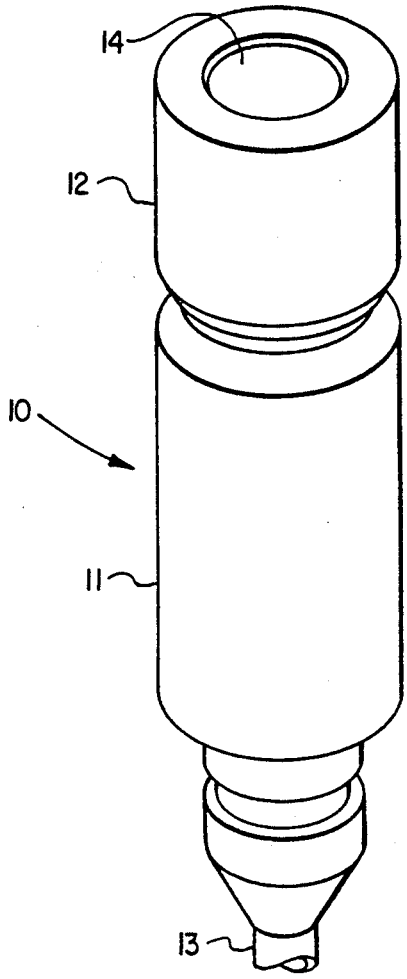
FIG. 2 is an assembled isometric view of a connector socket constructed in accordance with the invention.

The low entry force connector socket of the present invention is shown in FIGS. 1 and 2 where it is generally designated 10. From those figures, it can be seen that it includes a generally cylindrical outer body 11, and a cap 12. The cylindrical outer body 11 is fitted with or includes a pin member 13 for connection to other wiring or other connectors (not shown). The cap is provided with an axial opening 14 through which a pin of another connector may be inserted. The cap has a cavity 15 therein, and the outer body has a cavity 16 therein. Together, cavities 15 and 16 accommodate inner cage 17 within them. Inner cage 17 is formed with a pair of external circumferential ribs 23 and 24.

Inner cage 17 has an upper end rim 18 and a lower end rim 19. End rims 18 and 19 are respectively provided with notches designated 20 and 21 in FIG. 1. Wires which are designated 22 in FIG. 1 are hooked or reverse-bent into notches 20 and 21 of the inner cage 17 in a manner to be described.

Figure 3:
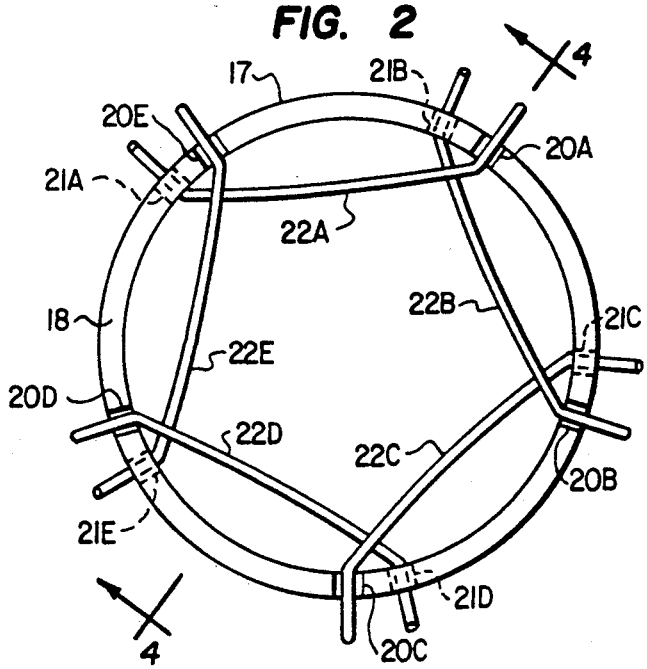
FIG. 3 is a top plan view of an inner cage with connector wires installed therein to form a wire basket in accordance with the invention.
Figure 4:
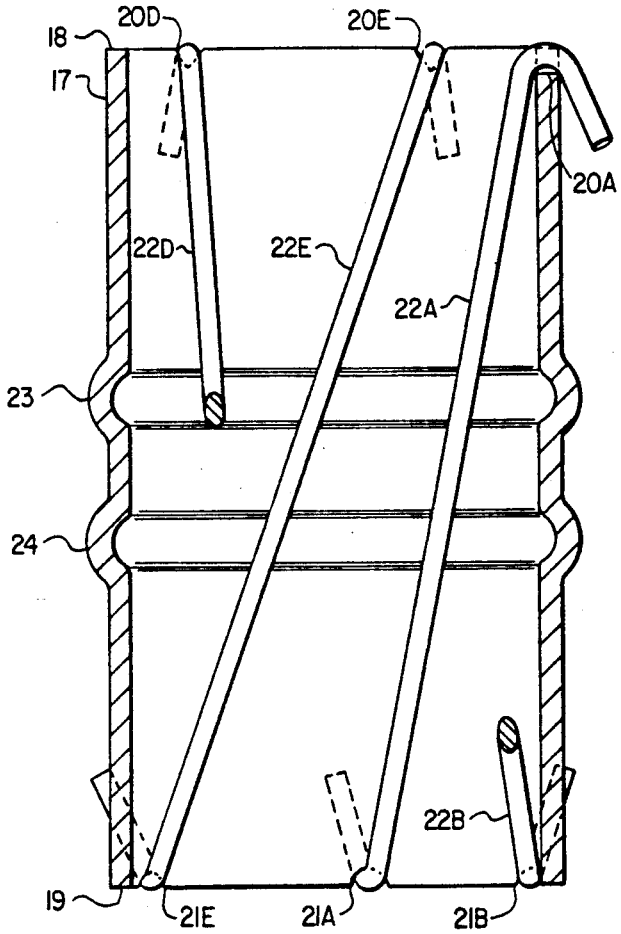
FIG. 4 is a cross-sectional elevational view of a cage having connector wires installed therein, the section being taken on the line 4—4 of FIG. 3.

The manner in which the wires 22 are mounted in inner cage 17 can best be understood by considering FIGS. 3 and 4 together, as well as FIG. 1. In FIGS. 3 and 4, the notches 20 on upper end rim 18 are individually designated 20A through 20E, working clockwise around the rim as FIG. 3 is drawn. Similarly, the notches 21 in bottom end rim 19 are numbered 21A through 21E, again working clockwise around rim 19 as FIG. 3 is drawn. A total of five wires are shown in FIG. 3 hooked or reverse-bent around end rims 18 and 19 in the notches 20 and 21, respectively thereof. The five wires in FIG. 3 (and those that appear in FIG. 4) are designated 22A through 22E clockwise around the figure as FIG. 3 is drawn.

A consideration of FIGS. 1, 3 and 4 will reveal that the five wires 22A through 22E are respectively hooked or reverse-bent into the notches on the end rims of the cage near the ends of the wires. This arrangement of wires collectively forms what is termed herein a wire "basket" which has a virtual inner diameter that is smaller than the inner diameter of cage 17. This inner diameter may be visualized to be the same as the diameter of a circle inscribed within the approximate pentagon of wires appearing in FIG. 3. When a connector pin (not shown) is inserted downwardly into the wire basket shown in FIG. 3, if it is somewhat larger than the virtual inner diameter of the wire basket, the wires 22A through 22E will yieldingly displace radially outward to accommodate the connector pin. But they will not yield any farther than is necessary to accommodate it, and will remain in snug contact with it, thereby providing a good mechanical and electrical contact between the wires and the pin. The wires, of course, are in good mechanical and electrical contact with the cage 17, by virtue of being hooked thereon, and as will appear in the discussion below, the cage is in good mechanical and electrical contact with the outer body 11 and, hence, its pin 13 by virtue of the manner in which the cage is frictionally engaged by and enclosed in outer body 11.

The wire basket is so formed by the positioning of the wire holding notches 20 and 21 on the end rims of cage 17 that over the length of the cage the wire ends are rotationally offset from one another by a selected angle. The selected angle is preferably larger than the simple division of 360° by the number of wires, five in the case of FIG. 3, to yield 72°. In the case of the embodiment shown in FIG. 3, the rotational offset between notch 20A on end rim 18 and notch 21A on end rim 19 is 12° greater than 72°, i.e. 84°. It should further be noted that notch 21B is rotationally offset from notch 20A by an angle smaller than the selected angle, its degree of offset being 12°. These angular relationships play an important role in the assembly or formation of a wire basket within cage 17, as will be discussed in detail below. Here, however, it may be pointed out that wire 22A has three notches associated with it, namely, notch 20A on upper end rim 18, notch 21B on lower end rim 19, and notch 21A, also on lower end rim 19. As will be explained below, wire 22A is first hooked into notch 20A at near one end of the wire. The other end of wire 22A is then temporarily hooked or reverse-bent into notch 21B. Next in the sequence of forming the wire basket, the hooked end of wire 22A which is temporarily residing in notch 21B is moved over to its final position in which it is hooked into notch 21A. This kind of operation is preferably simultaneously carried out with respect to all five wires in order to accomplish formation of the basket in a rapid and efficient manner.

Figure 5:
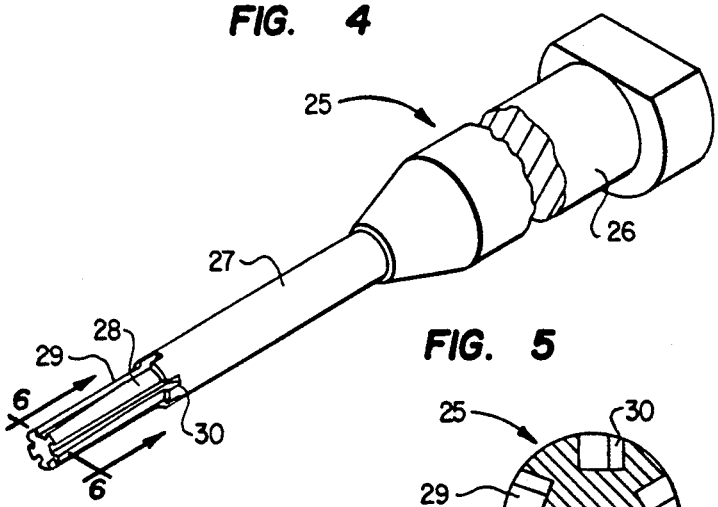
FIG. 5 is an isometric view, partially broken out, of a wire installation mandrel employed in accordance with the invention.
Figure 6:
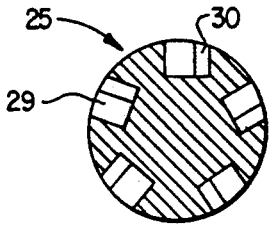
FIG. 6 is a cross-sectional view of a portion of the mandrel of FIG. 5, the section being taken on the line 6—6 of FIG. 5.
Figure 7:
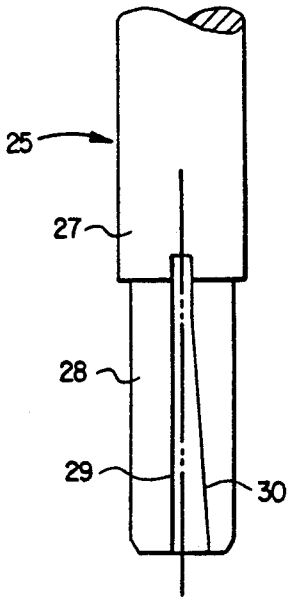
FIG. 7 is a fragmentary elevational view, somewhat simplified, of a portion of the wire installation mandrel of FIGS. 5 and 6.

Attention is next directed to FIGS. 5, 6 and 7 which illustrate an upper mandrel employed in accordance with the method of the invention in the installation of the contact wires within the cage. The upper mandrel is designated generally as 25. It includes a body portion 26 and an upper shank 27 and lower shank 28. As will appear in the discussion of the method aspect of the invention, the upper mandrel is mounted for use in a generally vertical position with the lower shank 28 below the upper shank 27. It is mounted for controlled reciprocal vertical movement. A set of wire guiding channels 29 is provided in the lower shank 28. These channels run generally parallel to the axis of the mandrel, and the number of them is equal to the number of contact wires which are to be installed within the cage. Thus, in the embodiment shown in the drawings, five wire guiding channels 29 are provided. As can best be seen in FIG. 5, the end of the bottom of channel 29 is flared outwardly as at 30 so that the end of a wire being pushed upwardly in a channel 29 will tend to flare radially outwardly when it encounters the upper end of the channel. Furthermore, it should be noted that the channel 29 is provided with a flared side wall 30 on one side so that a wire residing in a channel 29 may be moved at its lower end through a small circumferential path for a few degrees, such as 12°. The purpose of this arrangement will appear more fully hereinbelow. It should be noted that in FIGS. 5 and 6, five wire guiding channels 29 are illustrated, but that for purposes of clarity of illustration, only one such channel is shown in FIG. 7.

Figure 8:
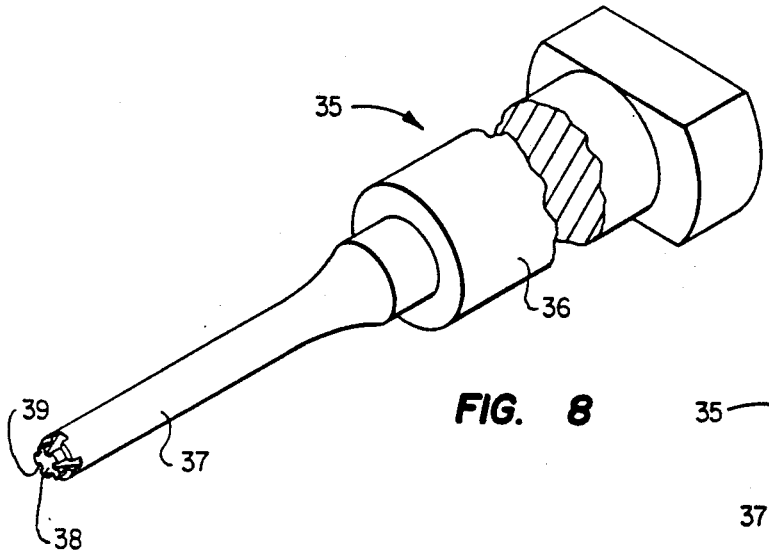
FIG. 8 is an isometric view, partially broken out, of a second wire installation mandrel employed in accordance with the invention.
Figure 9:
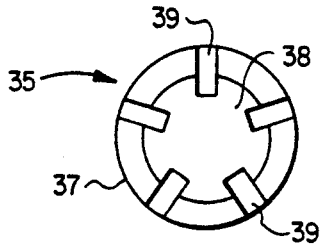
FIG. 9 is an end elevational view of the mandrel of FIG. 8.

In FIGS. 8 and 9, there is shown another tool which is used in the installation of contact wires into the cage of the connector socket of the invention. In FIGS. 8 and 9, the lower tooling mandrel is designated generally as 35. It includes a body portion 36 and a shank 37. In use, the lower mandrel is mounted vertically with shank 37 upwardly. As will appear in the discussion below, it is mounted both for reciprocation and rotation. The upper end of the shank has a boss 38 thereon of reduced diameter compared to the diameter of the shank itself. Also, at the upper end of shank 37 are a series of five wire engaging grooves 39, one for each of the wires to be installed within a cage. As can best be seen in FIG. 8, the grooves 39 extend into boss 38 from shank 37, and the grooves have a curved bottom so that relative movement between the shank and a wire residing in a given groove will result in the portion of the wire within the groove being flared radially outwardly. The purpose of this arrangement is discussed more fully below.

Figure 11:
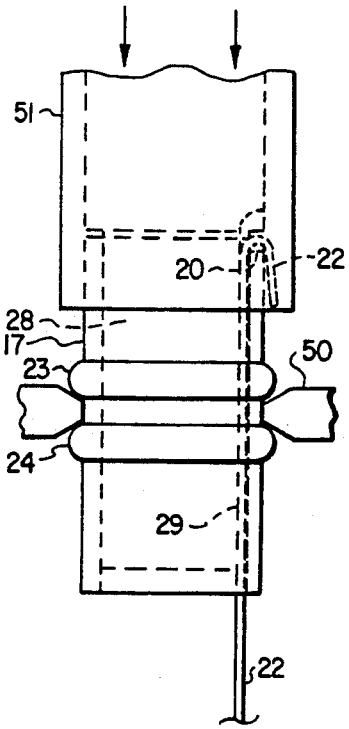
Figure 12:
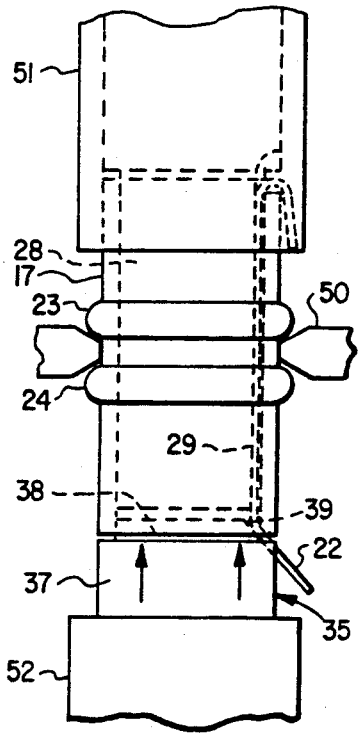
Figure 13:
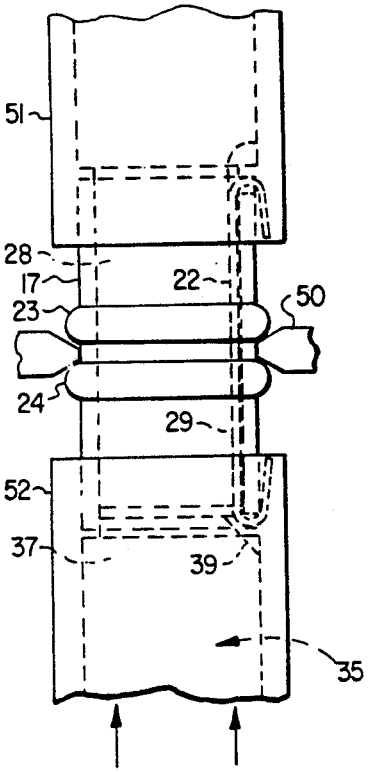
Figure 14:
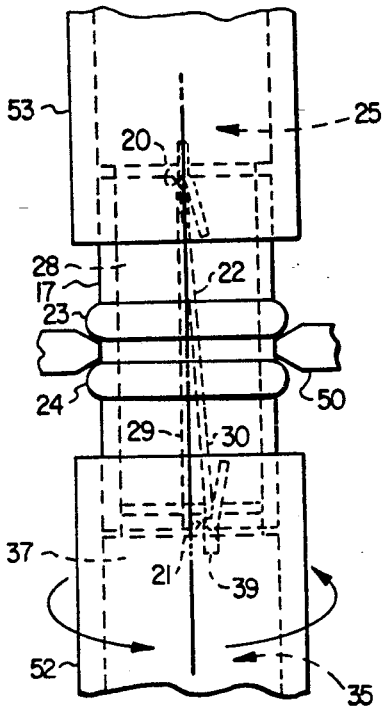
Figure 15:
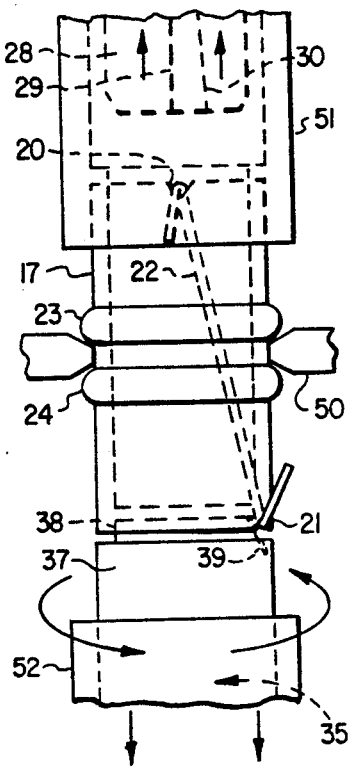

FIGS. 10 through 15 illustrate diagrammatically the method aspects of the invention which relate to the installation of the contact wires 20 within cage 17. In these figures, for purposes of clarity of illustration, some hidden lines are omitted, and only those parts of the tooling which are involved with the installation of a single wire are shown, although it should be understood that five wires are being simultaneously installed, rather than just one. Also, only a single wire is shown for the same reasons. In addition, support and actuating equipment is either not shown, or is shown in very simplified form, these items being well understood by those of skill in the art. Next, it should be noted that FIGS. 10 through 13 are drawn to present the manufacturing process from one point of view, while FIGS. 14 and 15 are drawn to present the balance of the manufacturing process from a point of view which has been displaced around the tooling in a counter-clockwise manner (viewed from the top) of 90°. It is also important to note that FIGS. 13 and 14 represent almost the same instant in time, with the manipulation shown in FIG. 14 occurring only very slightly later than those in FIG. 13.

Figure 10:
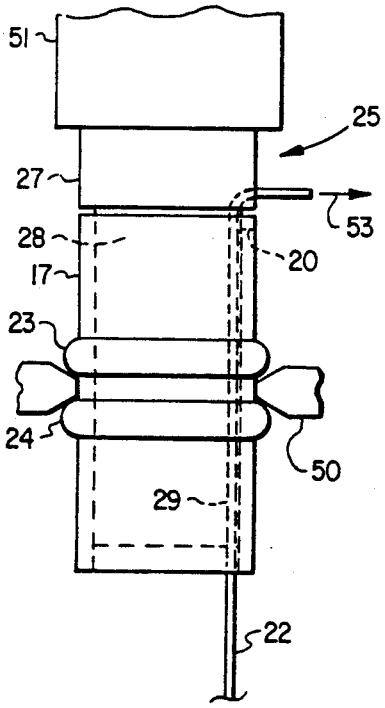
FIGS. 10 through 15 are simplified sequential views of a cage of the connector of the invention having a wire installed therein, together with the associated tooling employed in such operations, the views being elevational views, and the point of view being rotated 90° between FIGS. 13 and 14.

In FIGS. 10 through 15, an inner cage 17 is shown held in a vertical position by gripping jaws 50. In FIG. 10, upper mandrel 25 is shown with its lower shank 28 inserted into the interior of inner cage 17, and with its upper shank position just above the inner cage. The first step in the installation of wire 22 is to feed it upwardly in channel 29 in a path generally parallel to the axis of cage 17. As is shown in FIG. 10, when the wire reaches the upper end of channel 29, it is flared radially outwardly as indicated by the arrow 53.

Attention is now directed to FIG. 11. Part of the upper tooling involved in the installation of wires is outer sleeve 51 which surrounds upper shank 27 of the upper mandrel, but which is vertically movable relative thereto. As can be seen in FIG. 10, the next step is to move outer sleeve 51 downwardly which has the effect of reverse-bending, or hooking, the upper end of wire 22 into a notch 20 on the upper end rim of inner cage 17. The inner diameter of upper sleeve 51 is large enough to accommodate both cage 17 and the portion of wire 22 which is hooked outside of cage 17.

Moving now to FIG. 12, there is shown the next movement which involves lower mandrel 35. This mandrel is moved upwardly to place its boss 38 within the bottom of inner cage 17, and with the shank 37 of the mandrel positioned just below the inner cage 17. By this movement, channel 39 in the lower mandrel 35 engages wire 22 near its bottom end and puts a preliminary bend in it as is illustrated in FIG. 12.

Attention is now directed to FIGS. 13 and 14, together, which, as explained above, illustrate actions which take place almost simultaneously. The tooling for installing wires 22 includes lower outer sleeve 52 which surrounds shank 37 of lower mandrel 35. As is shown in FIG. 13, lower sleeve 52 is moved vertically upward and in doing so, it reverse-bends or hooks the lower end of wire 22 around the lower rim of inner sleeve 17. More particularly, as is shown in FIG. 14, the upward movement of lower sleeve 52 reverse-bends the lower end of wire 20 into a notch 21 in the lower rim of inner cage 17. As appears in FIG. 14, notch 21 is offset to the right, as FIG. 14 is drawn, some 12° from notch 20 at the upper end of inner cage 17 into which the upper end of wire 22 is hooked or reverse-bent. This offsetting is permitted by wire channel 29 in the lower shank 28 of the upper mandrel 25, because of the angled wall 30 of that channel. The wire 22 is now securely hooked to the upper and lower rims of inner cage 17, and is held in that position by sleeves 51 and 52, but is not in its final position. The foregoing offsetting of the lower end of wire 22 by about 12° into notch 21 is accomplished by a partial rotation of lower mandrel 35.

The purpose of initially securing the wire 22 in notches 20 and 21, which are rotationally offset only by 12°, is to form secure reverse-bent hooks by essentially axial forces without, at this point, introducing the twisting forces or the torquing forces which would tend to twist wire 22 if the hooking action were deferred to the time when the wire is being moved to, or in, its final rotationally offset position.

FIG. 15 illustrates the next step in the positioning of wire 22. In this step, upper sleeve 51 and shank 28 of the upper mandrel 25 are withdrawn upwardly to a position free of engagement with inner cage 17. The boss 38 and shank 37 of lower mandrel 35 are next rotated approximately through 72° to displace the lower hooked end from initial notch 21 to a final notch 21. As the lower end of the wire is rotationally offset from the upper end of the wire in the manner just described, the wire is tensioned, and stretches elastically slightly to accommodate its new position.

Figure 16:
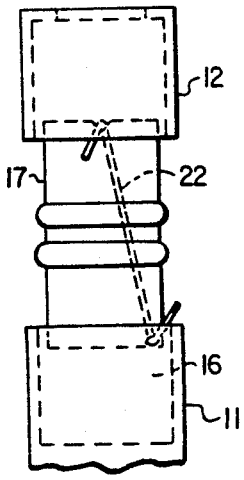
FIGS. 16 through 19 are a series of simplified sequential elevational views showing the installation of a cage in an outer body and cap to form a completed connector in accordance with the invention.

Attention is now directed to FIGS. 16 through 19 which show the next steps in the manufacturing sequence to bring the connector socket of the invention to completion. In FIG. 16, a cage 17 is shown with a wire 22 installed therein in its final position. A comparison of FIGS. 15 and 16 will reveal that the wire shown in each figure is in substantially the same position. It should be understood that a total of five wires are in position in FIG. 16, but only one is shown for clarity of illustration. The inner cage 17, at its bottom end, is partially placed in cavity 16 of outer body 11. At the top end of inner cage 17, cap 12 is placed partially over the upper end of the cage.

Figure 17:
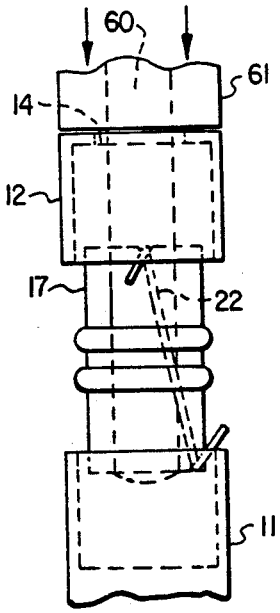
Figure 18:
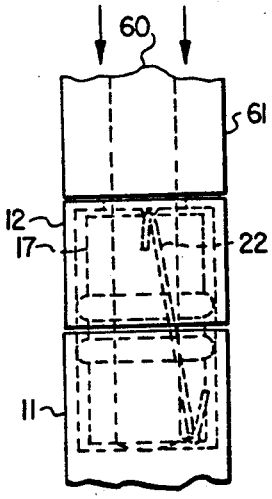

Moving now to FIG. 17, it can be seen that two additional pieces of tooling are involved in the next stage of the manufacturing process. One of these is tool pin 60, which is inserted downwardly through the opening 14 in cap 12 and into and through the interior of cage 17. Within cage 17, it engages the wires 22, which are now formed into a basket, and it displaces them somewhat, the displacement being generally radially outwardly. The size of pin 60 is selected to provide the desired connecting force in the connector, and in particular in the wire basket thereof, and one of the factors taken into account in selecting the diameter of the tool pin is the diameter of the connector pin with which the socket will eventually be used. In general, the larger the tool pin diameter is compared to the diameter of the connector pin, the lower the entry and disconnect force will be.

The other item of tooling involved at this stage in the manufacturing process is cylindrical ram 61 which has a bore therethrough to accommodate tooling pin 60 and permit relative vertical movement between the pin and the ram. As appears in FIGS. 17 and 18 taken together, the ram 61 is moved downwardly to urge the outer body and cap, together, over and surrounding the inner cage 17. The parts are so dimensioned that snug frictional contact is obtained between portions of the cage, the body, and the cap, and particularly good frictional contact between the hooked end portions of the wires 22 and the body and cap, respectively. Some amount of cold working and cold flow of material of the body and cap, and perhaps also the wires, may take place. By maintaining the tooling pin 60 in position inside the cage during the steps in which the cap, cage, wires, and body are unified, there is prevented any tendency of the wires 22 to bow inwardly with or without twisting; such bowing and/or twisting has been found to be a primary source of lack of uniformity, and presence of uncertainty in insertion and disconnect force from one connector to another. Thus, these effects are desirably eliminated by the use of tooling pin 60.

Figure 19:
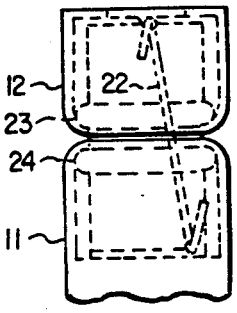

Attention is now directed to FIG. 19 in which the now united parts of the connector socket are secured in united position by deforming or cold working the bottom edge of cap 12 around rib 23 to the shape shown in FIG. 19, and by also deforming the top edge of body 11 around external rib 24 of the cage 17. In this manner, the parts are securely united together and good mechanical and electrical contact is established between all of the components of the connector socket. The other important goal of the invention, uniformity and low value of insertion and disconnect force is also secured thereby.

What is claimed is:

1. A method of making a connector socket of the kind comprising a generally cylindrical inner cage, at least one contact wire positioned within said cage, said contact wire being rotationally offset by a selected angle from one end of said cage to the other, and enclosing means for enclosingly engaging said cage, said method comprising:

providing wire seating notches on the rims of each end of said cage, each said wire having three seating notches associated therewith, a first notch on a first cage end rim, a second notch on a second cage end rim and rotationally offset from said first notch by an angle smaller than said selected angle, and a third notch on said second cage end rim and rotationally offset from said first notch by said selected angle;

feeding at least one wire into said cage in a path of movement substantially parallel to the axis of said cage;

hooking a first end of said wire on said first notch;

hooking a second end of said wire on said second notch;

moving the hooked second end of said wire from said second notch to said third notch; and enclosing said cage with said at least one wire hooked thereto in said enclosing means.

2. A method in accordance with claim 1 in which said second notch is rotationally offset from said first notch by about 12°.

3. A method in accordance with claim 1 in which a plurality of contact wires are fed into said cage and in which the second seating notch of a first contact wire comprises the third seating notch of a second contact wire.

4. A method in accordance with claim 1 in which a plurality of contact wires are fed into said cage and said selected angle comprises 360° divided by the number of said contact wires plus said angle smaller than said selected angle.

5. A method in accordance with claim 1 in which a plurality of contact wires are fed into said cage and said selected angle comprises 360° divided by the number of said contact wires minus said angle smaller than said selected angle.

6. A method of making a connector socket for engaging a connector pin, said socket being of the kind comprising a generally cylindrical inner cage having an upper end rim and a lower end rim, a plurality of contact wires positioned within said cage, said contact wires being rotationally offset from one end of said cage to the other and hooked in notches in the upper end rim and the lower end rim of said cage to thereby define a pin-engaging wire basket having a virtual minimum diameter smaller than the outer diameter of said pin, and enclosing means for enclosingly engaging said cage and the hooked ends of said wires, said method comprising:

inserting a tool pin into said wire basket after its construction within said cage but before application of said enclosing means, said tool pin having a diameter selected in view of the diameter of said connector pin with which the socket is to be used and the desired connecting force;

thereafter, while said tool pin is inserted in said wire basket, applying said enclosing means around said cage to grippingly engage said cage and said hooked ends of said wire, to thereby fix the connecting force of said socket; and thereafter removing said tool pin from said wire basket.

7. A method in accordance with claim 6 in which said enclosing means comprise an outer body and a cap, and further in which said cap and body are applied to said cage to enclose it by being pressed together thereover.

8. A method of making a connector socket for engaging a connector pin, said socket being of the kind comprising a generally cylindrical inner cage having an upper end rim and a lower end rim and a pair of circumferential ribs thereon at a mid region thereof, a plurality of contact wires positioned within said cage, said contact wires being rotationally offset from one end of said cage to the other and hooked in notches in the upper end rim and the lower end rim of said cage to thereby define a pin-engaging wire basket having a virtual minimum diameter smaller than the outer diameter of said pin, and enclosing means for enclosingly engaging said cage and the hooked ends of said wires, said method comprising:

inserting a tool pin into said wire basket after its construction within said cage but before application of said enclosing means, said tool pin having a diameter selected in view of the diameter of said connector pin with which the socket is to be used and the desired connecting force;

thereafter, while said tool pin is inserted in said wire basket, applying said enclosing means around said cage to grippingly engage said cage and said hooked ends of said wires, to thereby fix the connecting force of said socket;

thereafter removing said tool pin from said wire basket; and deforming the edges of said cap and body therearound to unify the parts of said connector socket electrically and mechanically.

9. A method of making a connector socket for engaging a connector pin, said socket being of the kind comprising a generally cylindrical inner cage, a plurality of contact wires positioned within said cage, said contact wires being rotationally offset from one end of said cage to the other by a selected angle and hooked in notches in the end rims of said cage to thereby define a pin-engaging wire basket having a virtual minimum diameter smaller than the outer diameter of said pin, and enclosing means for enclosingly engaging said cage and the hooked ends of said wires, said method comprising:

providing wire seating notches on the rims of each end of said cage, each of said wires having three seating notches associated therewith, a first notch on a first cage end rim, a second notch on a second cage end rim and rotationally offset from said first notch by an angle smaller than said selected angle, and a third notch on said second cage end rim and rotationally offset from said first notch by said selected angle;

feeding each of said wires into said cage in a path of movement substantially parallel to the axis of said cage;

hooking a first end of each of said wires on its said first notch;

hooking a second end of each of said wires on its said second notch;

moving the hooked second end of each of said wires from its said second notch to its said third notch thereby forming said wire basket;

inserting a tool pin into said wire basket after its construction within said cage but before application of said enclosing means, said tool pin having a diameter selected in view of the diameter of said connector pin with which the socket is to be used and the desired connecting force;

thereafter, while said tool pin is inserted in said wire basket, applying said enclosing means around said cage to grippingly engage said cage and said hooked ends of said wires, to thereby fix the connecting force of said socket;

thereafter removing said tool pin from said wire basket; and enclosing said cage in said enclosing means.

* * * * *